US006342865B1

(12) United States Patent
Chandler et al.

(10) Patent No.: US 6,342,865 B1
(45) Date of Patent: Jan. 29, 2002

(54) SIDE-FED OFFSET CASSEGRAIN ANTENNA WITH MAIN REFLECTOR GIMBAL

(75) Inventors: Charles W. Chandler, San Gabriel; Louis C. Wilson, Sylmar, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/725,616

(22) Filed: Nov. 29, 2000

(51) Int. Cl.[7] ..... H01Q 1/42

(52) U.S. Cl. ..... 343/781 CA; 343/765; 343/DIG. 2

(58) Field of Search ..... 343/765, 781 R, 343/781 P, 781 CA, 878, 880, 882, DIG. 2

(56) References Cited

U.S. PATENT DOCUMENTS 4,439,773 A * 3/1984 Chu ..... 343/778
4,618,866 A * 10/1986 Makino et al. ..... 343/779
4,866,457 A * 9/1989 Hogg ..... 343/781 CA
5,859,619 A * 1/1999 Wu et al. ..... 343/781 CA
6,043,788 A * 3/2000 Seavey ..... 343/781 CA

* cited by examiner

*Primary Examiner*—Tho Phan
(74) *Attorney, Agent, or Firm*—Connie M. Thousand

(57) ABSTRACT

A steerable antenna comprises a steerable main reflector and a stationary feed assembly and subreflector assembly configured in a side-fed configuration where the feed assembly is to a side of both the main reflector and the subreflector. The main reflector, subreflector and feed assembly together produce an antenna beam which is directed in a preselected direction by the main reflector. A gimbal is coupled to the main reflector for positioning the main reflector and scanning the antenna beam over a preselected coverage area while the feed assembly and subreflector remain substantially stationary.

16 Claims, 4 Drawing Sheets

SIDE-FED OFFSET CASSEGRAIN ANTENNA WITH MAIN REFLECTOR GIMBAL

BACKGROUND OF THE INVENTION

The present invention relates generally to antennas for satellites and more particularly, to a side-fed reflector antenna for a satellite which provides a steerable antenna beam for full Earth field-of-view coverage with little degradation in the beam quality over the scan range.

In satellite communications systems, the antenna architecture has been to attach the entire antenna, comprising a parabolically curved main reflector, a feed horn, and a subreflector, to a positioning mechanism, such as a gimbal which moves the entire antenna to position or scan the antenna beam over the earth. Two factors contribute to the heavy weight of such a system. First, to maneuver a large mass and therefore the momentum, a heavy duty gimbal system is necessary. Second, to secure the entire antenna assembly in place during the launching vibration requires the use of a heavy latching structure during launch.

One antenna that addresses the above concerns is described in U.S. Pat. No. 5,870,060 and is depicted in FIG. 1. The antenna has a fixed non-moving feed 3 and associated electronics 5 and, a gimbaled 7,9 main reflector 10. Only the reflector 10 is moved to scan the beam, depicted by the dotted lines and arrows marked 11. The shortfall of this antenna is that it incurs high scan losses which is compensates for by special design of the reflector 10 and feed 3, which is expensive. This antenna additionally utilizes a long focal length to minimize the scan loss which results in the antenna requiring a substantial amount of real estate on a spacecraft which is typically at a premium. The antenna also uses an oversized reflector 10 to compensate for the gain loss. These compensations however do not solve the high cross-polarization level, high sidelobe level, and beam distortion problems which occurs when the reflector 10 is scanned off axis, particularly when the antenna is scanned to high scan angles such as the +/−11 degrees required for earth coverage from a geosynchronous satellite. The long focal length additionally results in the antenna requiring a substantial amount of real estate on a spacecraft which is typically at a premium.

What is needed therefore is a light weight antenna which has a low cross-polarization level and low beam distortion when scanned over a field of view, particularly when scanned over the Earth from a geosynchronous orbiting satellite.

SUMMARY OF THE INVENTION

The preceding and other shortcomings of the prior art are addressed and overcome by the present invention which provides a steerable antenna. In a first aspect, the steerable antenna assembly comprises a main reflector, a feed and a subreflector which together are oriented to define a side-fed dual reflector geometry where the feed is to a side of both the subreflector and the main reflector. The feed, subreflector and main reflector together producing an antenna beam which is directed in a preselected direction by the main reflector. A gimbal is coupled to the main reflector for positioning the main reflector and scanning the antenna beam over a preselected coverage area. The feed and subreflector remain substantially fixed in position when the main reflector is positioned and the antenna beam is scanned.

In a second aspect, the steerable antenna is coupled to a satellite in a geosynchronous orbit about the earth where the earth subtends approximately a twenty two degree cone of coverage from the satellite. The main reflector and gimbal are configured to scan the antenna beam over the earth field of view.

BRIEF DESCRIPTION OF THE DRAWINGS

Reference is now made to the detailed description of the preferred embodiments illustrated in the accompanying drawings, in which.

DETAILED DESCRIPTION OF THE PREFERRED EMBODIMENTS

Figure 1:
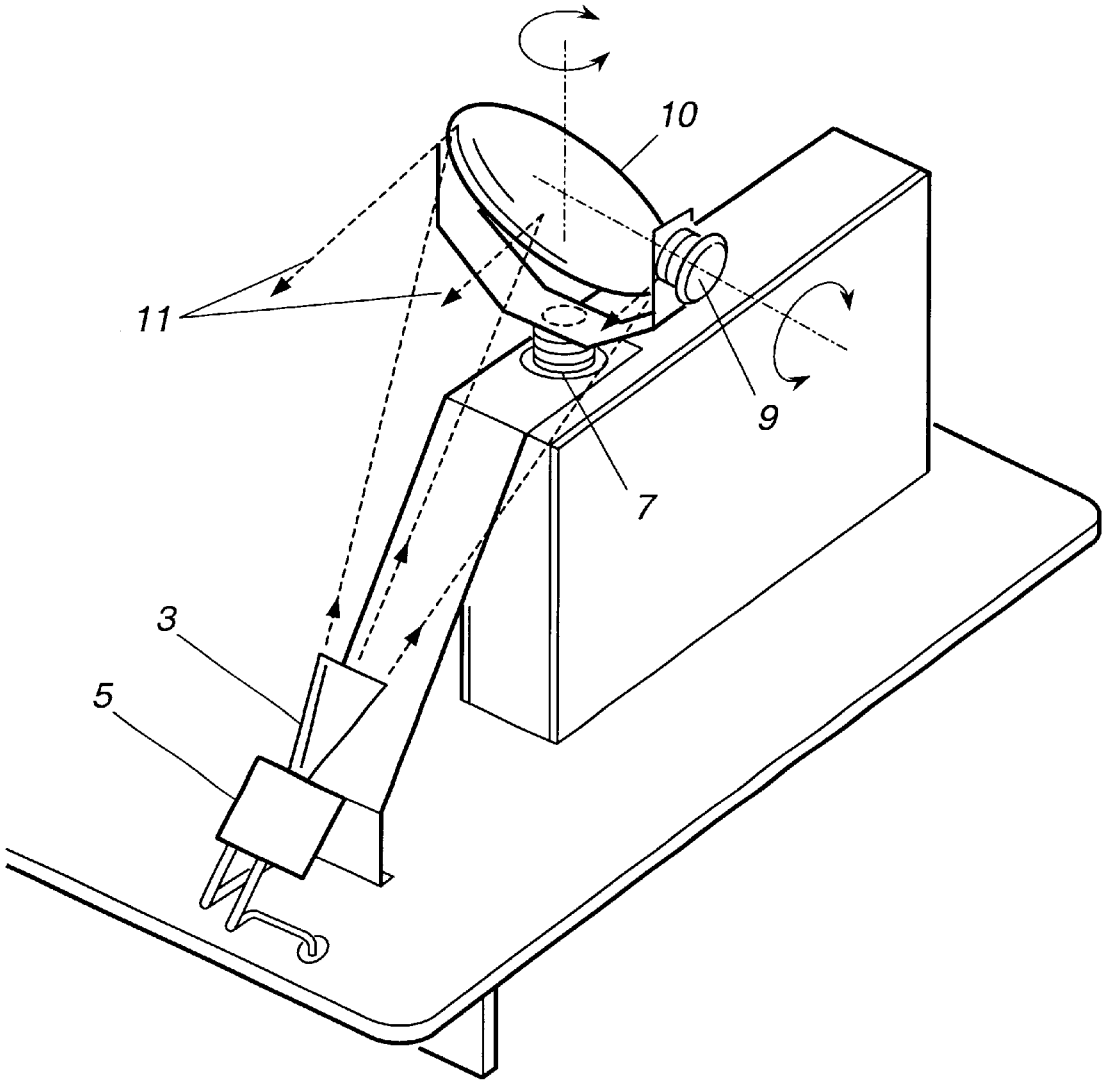
Prior Art Figure 1
FIG. 1 is a prior art steerable reflector antenna.
Figure 2:
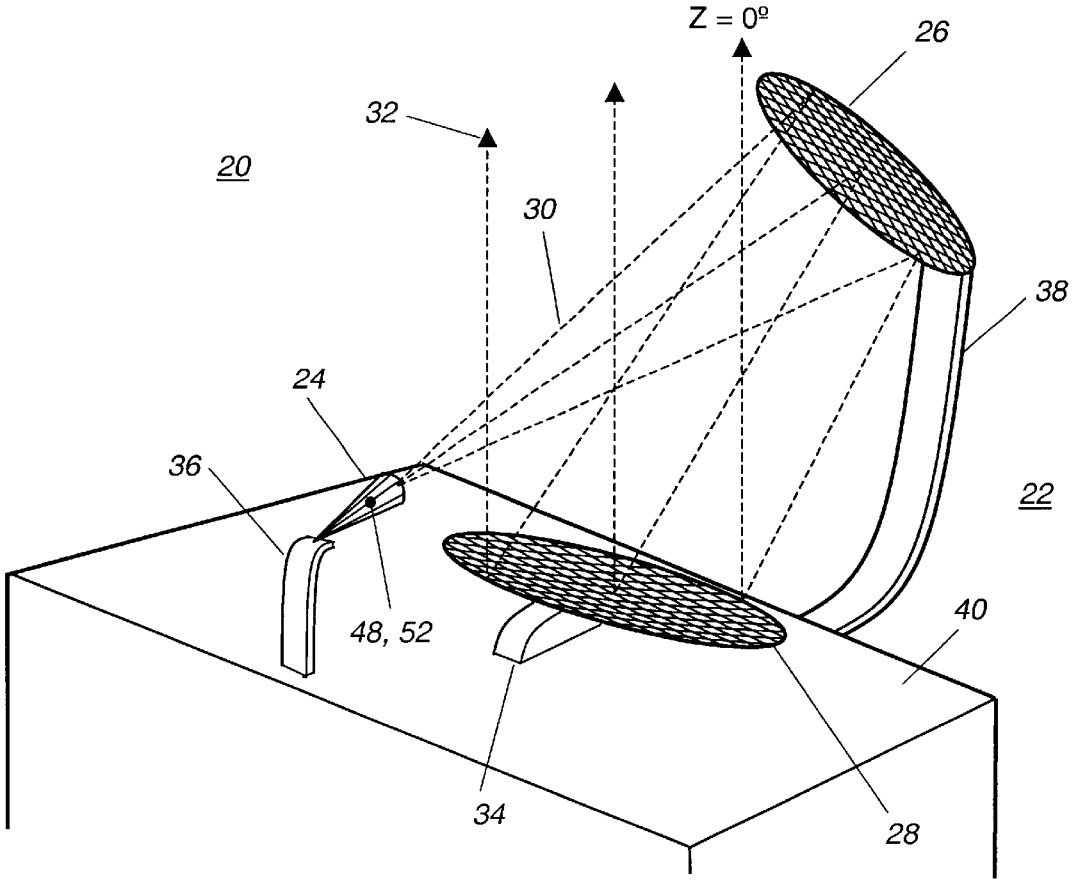
FIGS. 2 & 3 are isometric drawings, each of which shows a portion of a satellite having a steerable side-fed dual reflector antenna assembly coupled thereto in accordance with the present invention.

Referring to FIG. 2, a portion 20 of a spacecraft having a reduced weight antenna system 22 for scanning an antenna beam is illustrated. The antenna system 22 of the present invention is preferably used for communications between the spacecraft and the Earth where the spacecraft is preferably located in a geosynchronous or near geosynchronous orbit and the antenna beam is scanned over an earth field of view.

Figure 3:
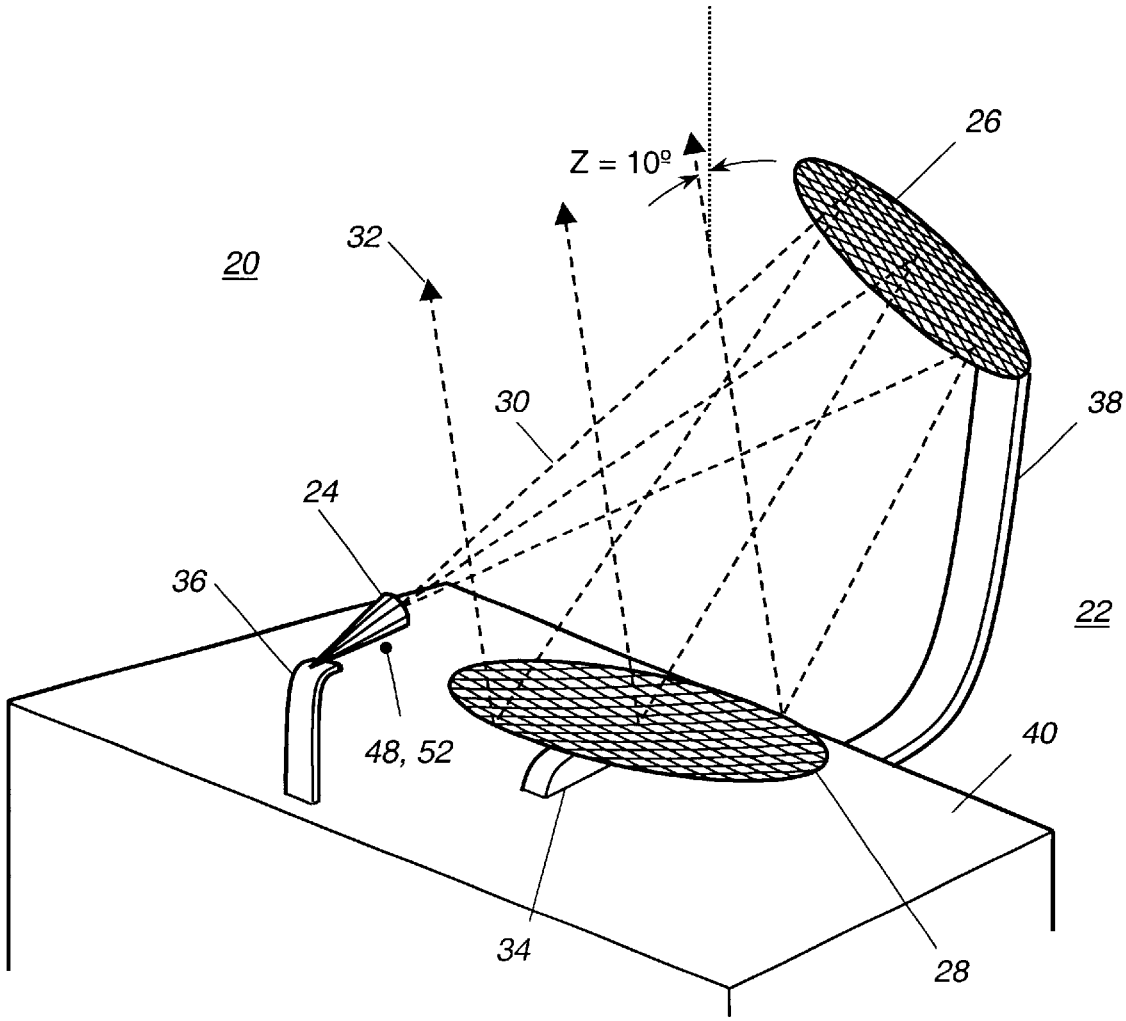
Figure 4:
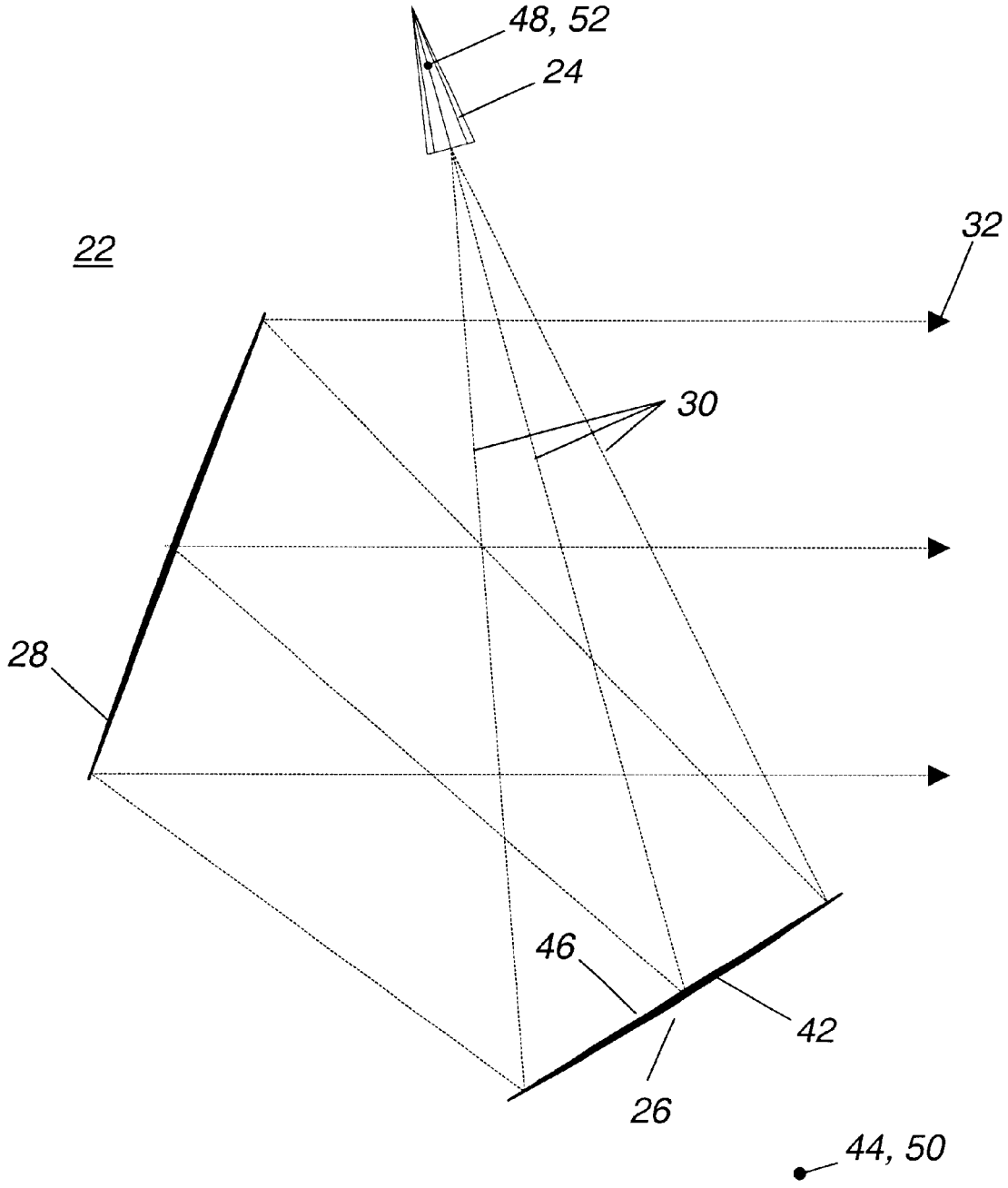
FIG. 4 is a side plane view of a side-fed dual reflector antenna system in accordance with the present invention.

Referring to FIGS. 2–4, an embodiment of a scanning antenna assembly configured according to the invention is illustrated. FIGS. 2 & 3 depict the antenna assembly 22 in an isometric view fashion whereas FIG. 4 depicts the antenna assembly 22 in a side plane view fashion. The antenna assembly 22 includes a feed assembly 24, a subreflector 26 and a main reflector 28. The feed assembly 24 preferably contains a single feed horn and associated electronics but can also contain a feed array. The feed assembly 22, subreflector 26 and main reflector 28 are configured in a side-fed dual reflector antenna configuration. The location of the feed assembly 24 to the side of both the subreflector 26 and main reflector 28 define the antenna assembly 22 as being "side-fed."

The side-fed dual reflector configuration provides an optical system having a long effective focal length in a compact structure. A relatively long effective focal length of the optical system ensures low beam squint and virtually distortionless scanning to wide scan angles. Coupling a subreflector 26 with the main reflector 28 in a side-fed dual reflector configuration enables an optical system to be packaged into an extremely small envelope while providing an antenna 22 free of blockage. A more detailed discussion of side-fed dual reflector antenna configurations can be found in the article Jorgenson et al. "Development of dual reflector multibeam spacecraft antenna system," IEEE Transactions of Antennas and Propagation, vol. AP-32, pp. 30–35, 1984. Note that the above description of the antenna pertains to the antenna being configured in a transmit mode. As is well known to one skilled in the art, the antenna can also be configured to operate in a receive mode.

Table 1 below gives an example of the parameters of the antenna 22 in accordance with a first embodiment of the invention.

TABLE 1

| Main Reflector | Subreflector |
|---|---|
| Vertex: x = 0, y = 0, z = 0 | Focus: x = 0, y = 0, z = 120" |
| Focal Length: 120" | Focus Distance: 70.9355" |
| RIM: | Rotation: 128.7101° |
| Center: x = 90.2374", y = 0, z = 0 | RIM: |
| Diameter: 24" | Center: x = 18.31052", y = 0, z = 0 |
| | Diameter: 20" |

The geometry and configuration of feed assembly 24, the subreflector 26 and the main reflector 28 discussed above preferably satisfy the cross-polarization cancellation condition $$\tan\frac{\gamma}{2} = \frac{1}{M} \times \tan\frac{\varphi}{2}$$

where y is the angle from the main reflector axis to the subreflector axis, ψ is the angle from the subreflector axis to the focal axis, and M is the magnification factor.

In the side-fed configuration, the illumination beam, depicted by the lines marked 30, are provided by the feed assembly 24 and are reflected by the subreflector 26 which directs the illumination beam 30 towards the main reflector 28. The illumination beam 30 is reflected from the main reflector 28 which produces an antenna beam. As indicated by the arrows marked 32, the antenna beam is directed in a preselected direction which is substantially or totally free of blockage by the subreflector 26 and feed assembly 24.

A gimbal 34 is coupled to the main reflector 28 and angularly moves the main reflector 28. The gimbal 34 is a conventional electrical positioning and sensor device which steers the main reflector 28 over a preselected scan area; that is, positions the main reflector's attitude and elevation. Since the electronic controls and electrical leads and accompany electrical circuits for supplying driving current to the gimbal and sending position information therefrom are known and not necessary to an understanding of the invention, they are not illustrated or further described. As those skilled in the art recognize, many gimbal arrangements may be used to steer the reflector, such as a bi-axial gimbal attached to the back side of the main reflector 28.

Only the main reflector 28 is gimbaled while the feed assembly 24 and subreflector 26 remain stationary in position. Through the gimbal controls, the direction of the antenna beam 32 is changed in attitude and elevation just like a mirror would deflect an incident light beam. For example, FIG. 2 depicts a boresight scan of the antenna 22, denoted as z=0° whereas FIG. 3 depicts a 10° scan of the antenna 22 denoted as z=10°. Since the main reflector 28 weighs only a fraction of the total assembly weight, a small size gimbal 34 and light weight holding device is sufficient to steer the antenna beam 32 and survive the vibration during satellite launch. That alone results in considerable weight savings.

The feed assembly 24 and subreflector 26 are each positioned in preselected, fixed locations and do not move with the main reflector 28. The feed assembly 24 and subreflector 26 are preferably mounted to separate brackets 36, 38, respectively, which are each mounted to the bulkhead 40 of a spacecraft 20. The brackets 36, 38 serve to fix the location of the feed assembly 24 and subreflector 26 thereby maintaining substantially fixed the relative distance between the feed assembly 24 and subreflector 26.

The main reflector 28 may be formed from a solid piece of metal that is concavely shaped into one of the conventional curves used for reflector type microwave antennas, such as parabolic or a section of a parabolic, or may be so formed of wire mesh or of composite graphite material, all of which are known structures.

The subreflector 26 may also comprise a solid piece of metal or be formed of wire mesh or a composite material. The subreflector 26 preferably has the shape of a portion of a hyperbola having a concave side 42 with an associated focal point 44 and a convex side 46 with an associated focal point 48.

The main reflector 28 has a main reflector focal point 50 and the subreflector 26 provides a secondary focus 52 for the main reflector 28. The position of the feed assembly 24 is preferably selected so that the feed assembly 24 is approximately co-located with the secondary focus 52 when the antenna beam 32 is directed to the center of the area to be scanned. This is known to one skilled in the art as a boresight scan and is indicated in FIG. 2 as z=0°. This positioning of the feed assembly 24 minimizes the displacement of the secondary focus 52 from the feed assembly 24 during scanning which minimizes the loss in gain of the antenna 22 over the area to be scanned. For example, if the scan area is a twenty two degree cone, the antenna must scan +/−11 degrees from the center of the scan area. Placing the feed assembly 24 at the secondary focus 52 when the antenna 22 is at a zero degree scan angle will result in the secondary focus 52 being displaced from the feed assembly 24 by only a small amount over the entire scan area.

As depicted in FIGS. 2 & 3, the feed assembly 24 becomes displaced from the secondary focus 52 of the main reflector 28 as the main reflector 28 is moved since the feed assembly 24 and subreflector 26 are held stationary during positioning of the main reflector 28. Displacing the feed assembly 24 from the secondary focus 52 of the main reflector 28 is normally associated with a large loss in gain, a high cross polarization level, a high sidelobe level and distortion in the beam shape. It was found that by using a side-fed antenna configuration, superior scanning performance can be realized even though the feed assembly 24 is displaced from the secondary focus 52 during scanning. For example, it was found that the scan loss was only 0.6 dB, the cross-polarization level increased by only 2.5 dB and the sidelobe level increase only about 3 dB when the main reflector 28 was scanned +/−11 degrees for a total scan of twenty two degrees. Good performance over an approximate twenty two degree scan angle is particularly desirable for an antenna used on a gyosynchronous satellite since the earth subtends approximately a twenty two degree cone angle from a geosynchronous orbit.

In addition to the superior scanning performance, the side-fed configuration has the additional advantage that the subreflector 26 does not block the main reflector 28. As such, the subreflector 26 can be made to be oversized without incurring gain loss and distortion associated with subreflector blockage of the main reflector 28. Typical subreflectors 26 are sized to be approximately ten to twenty wavelengths in diameter at a frequency of operation. The feed assembly 24 is typically designed to illuminate the edge of the subreflector 26 at a −8 to −14 dB level. Energy which does not illuminate the subreflector 26 is lost. This lost energy is known in the art as "spillover loss". It has been determined that an oversized subreflector, preferably between 50 and 100 wavelengths in diameter at a frequency of operation, will significantly reduce spillover loss and thereby increase overall antenna gain.

An additional benefit of the present invention is an improved long-term reliability of the antenna assembly 22. The gimbaled main reflector 28 eliminates any RF moving parts, such as RF rotary joint or flexible waveguide and cables, which are needed in some of the prior art gimbaled antenna approaches. The life, and consequently the performance degradation over life, of high frequency RF parts constantly flexing over a long period of time is always a design concern for a space-based system.

The antenna assembly described above offers significant improvements over those antenna system known in the art for use on satellites. The antenna systems of the invention are able to generate high gain, low scan loss, nearly undistorted, symmetrically shaped antenna beams for many uses, such as satellite earth coverage from a geosynchronous satellite.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

It will be appreciated by persons skilled in the art that the present invention is not limited to what has been shown and described hereinabove. The scope of the invention is limited solely by the claims which follow.

What is claimed is:

1. A steerable antenna assembly comprising:

a feed assembly positioned in a first fixed preselected location;

a subreflector positioned in a second fixed preselected location and being stationary with respect to the feed assembly;

a main reflector, the feed assembly, subreflector and main reflector oriented to define a side-fed dual reflector antenna geometry wherein the feed assembly is to a side of both the main reflector and the subreflector, the feed, subreflector and main reflector together providing an antenna beam, the main reflector directing the antenna beam in a preselected direction; and, a gimbal coupled to the main reflector for positioning the main reflector and scanning the antenna beam over a preselected coverage area, the main reflector and gimbal being configured to scan the antenna beam free of moving the feed assembly and the subreflector.

2. An antenna assembly as in claim 1, wherein the preselected coverage area is approximately a 22 degree scan cone.

3. An antenna assembly as in claim 1, wherein the main reflector and gimbal are configured to scan over an area equal to an earth field of view from a satellite in a geosynchronous orbit.

4. An antenna assembly as in claim 1, wherein the subreflector is greater than approximately 50 wavelengths at a frequency of operation.

5. An antenna assembly as in claim 1, wherein the preselected coverage area has a center point of coverage, the main reflector has a focal point, the subreflector being in the shape of a hyperbola and having a concave side and a convex side, the hyperbola having first and a second focus associated with the concave and convex sides, respectively, the subreflector positioned so that the first focal point and the main reflector focal points are coincident, the feed assembly being positioned at the second focus when the antenna beam is directed at the center point of coverage, whereby scanning the main reflector over the preselected coverage area displaces the main reflector focal point from the second focus.

6. The antenna assembly as in claim 5, wherein the preselected coverage area is an earth field of view from a satellite in geosynchronous orbit.

7. The antenna assembly system as in claim 1, wherein the configuration of the feed assembly, subreflector and main reflector satisfy a cross-polarization cancellation condition give by $$\tan\frac{\gamma}{2} = \frac{1}{M} \times \tan\frac{\varphi}{2}.$$

8. An antenna assembly as in claim 1, wherein the antenna assembly has a sidelobe level which changing by no more than about 3 dB when the main reflector is scanned over an approximate 22 degree scan cone.

9. An antenna assembly as in claim 1, wherein the antenna assembly has a scan loss which does not exceed 0.6 dB when the main reflector is scanned over an approximate 22 degree scan cone.

10. A satellite in a geosynchronous orbit about earth having a bulkhead with a steerable antenna mounted thereto, the antenna comprising:

a feed assembly mounted to the bulkhead in a first fixed preselected location;

a subreflector mounted to the bulkhead in a second fixed preselected location which is stationary with respect to the location of the feed assembly;

a main reflector, the feed assembly, subreflector and main reflector configured to define a side-fed dual reflector antenna geometry wherein the feed assembly is to a side of both the main reflector and the subreflector, the feed assembly, subreflector and main reflector together generating an antenna beam which is directed towards earth by the main reflector; and, a positioning mechanism coupled to the main reflector and operative to position the main reflector in attitude and elevation, the main reflector and positioning mechanism being configured to scan the antenna beam over the earth free of moving the feed assembly and the subreflector.

11. An antenna as in claim 10, wherein the subreflector is greater than approximately 50 wavelengths at a frequency of operation.

12. An antenna as in claim 10, wherein the main reflector and positioning mechanism are configured to scan the antenna beam over an approximate 22 degree scan cone.

13. An antenna as in claim 12, wherein the main reflector has a focal point, the subreflector being in the shape of a hyperbola having a concave side and a convex side, the subreflector having a first focal point associated with the concave side and a second focus associated with the convex side, the subreflector positioned so that the first focal point and the main reflector focal points are coincident, the feed assembly being positioned substantially at the second focus when the antenna beam is directed at a center of the earth coverage area, whereby scanning the antenna beam over the coverage area displaces the main reflector focal point from the secondary focus.

14. An antenna as in claim 12, wherein the antenna beam has a sidelobe level which changing by no more than about 3 dB when the main reflector is scanned over the earth.

15. An antenna as in claim 12, wherein the antenna has a scan loss which does not exceed 0.6 dB when the main reflector is scanned over the earth.

16. The antenna as in claim 10, wherein the configuration of the feed assembly, subreflector and main reflector satisfy a cross-polarization cancellation condition give by $$\tan\frac{\gamma}{2} = \frac{1}{M} \times \tan\frac{\varphi}{2}.$$

* * * * *